US007464572B2

(12) United States Patent
Miyanaga et al.

(10) Patent No.: US 7,464,572 B2
(45) Date of Patent: Dec. 16, 2008

(54) PROCESS FOR FORMING TUBULAR MEMBER

(75) Inventors: Kenji Miyanaga, Sayama (JP); Manabu Maruyama, Sayama (JP); Izuru Hori, Sayama (JP); Yuji Kanai, Sayama (JP); Kouki Mizutani, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 704 days.

(21) Appl. No.: 10/492,510

(22) PCT Filed: Oct. 23, 2002

(86) PCT No.: PCT/JP02/11009

§ 371 (c)(1),
(2), (4) Date: Aug. 16, 2004

(87) PCT Pub. No.: WO03/035299

PCT Pub. Date: May 1, 2003

(65) Prior Publication Data

US 2005/0029714 A1 Feb. 10, 2005

(30) Foreign Application Priority Data

Oct. 24, 2001 (JP) ..... 2001-325882

(51) Int. Cl.
*B21D 9/15* (2006.01)
*B21D 26/02* (2006.01)

(52) U.S. Cl. ..... 72/58; 72/62; 72/370.22; 72/342.7; 72/342.8; 72/342.94; 72/342.96; 29/421.1

(58) Field of Classification Search ..... 72/56, 72/58, 60, 61, 62, 370.22, 342.7, 342.8, 342.94, 72/342.96; 29/421.1
See application file for complete search history.

(56) References Cited

U.S. PATENT DOCUMENTS 5,481,892 A * 1/1996 Roper et al. ..... 72/61
5,890,387 A * 4/1999 Roper et al. ..... 72/58
5,960,660 A * 10/1999 Klaas et al. ..... 72/58

(Continued)

FOREIGN PATENT DOCUMENTS

EP 0930 109 A2 7/1999

(Continued)

*Primary Examiner*—David B Jones
(74) *Attorney, Agent, or Firm*—Carrier, Blackman & Associates, P.C.; William D. Blackman; Joseph P. Carrier

(57) ABSTRACT

A process for forming a tubular member is provided which includes a pre-forming process for tube-expanding (bulge) forming and bending forming a tubular material using first and second molds and a final forming process for crush forming a preformed tube using a third mold so as to give its cross section a desired shape, the pre-forming step being carried out using the first and second molds heated at temperatures equal to or higher than the recrystallization temperature of the tubular material and the final forming step being carried out using the third mold heated at temperatures equal to or lower than the recrystallization temperature of the tubular material. The process enables a tubular material of aluminum alloy to be formed into a tubular member of high precision and high quality which has expanded portions as well as bent portions and whose cross section varies across its length.

3 Claims, 6 Drawing Sheets

U.S. PATENT DOCUMENTS

| | | | | |
|---|---|---|---|---|
| 5,992,197 | A * | 11/1999 | Freeman et al. | 72/342.7 |
| 6,134,931 | A * | 10/2000 | Glaesener | 29/421.1 |
| 6,322,645 | B1 * | 11/2001 | Dykstra et al. | 72/62 |
| 6,349,583 | B1 * | 2/2002 | Kleinschmidt et al. | 72/62 |
| 6,613,164 | B2 * | 9/2003 | Dykstra et al. | 72/342.96 |

FOREIGN PATENT DOCUMENTS

| | | |
|---|---|---|
| EP | 1063 029 A1 | 12/2000 |
| JP | 62-259623 | 11/1987 |
| JP | 62-259624 | 11/1987 |
| JP | 62-270229 | 11/1987 |
| JP | 6-142781 | 5/1994 |
| JP | 11-309521 | 11/1999 |
| JP | 2002-18533 | 1/2002 |
| JP | 2002-126826 | 5/2002 |
| JP | 2002-126827 | 5/2002 |
| WO | WO 92/13653 | 1/1992 |

* cited by examiner

[TUBULAR MATERIAL AFTER TUBE-EXPANDING (BULGE) FORMING]

[TUBULAR MEMBER AFTER COMPLETION OF FORMING]

TUBE-EXPANDING (BULGE) FORMING (PREFORMING STEP)

BENDING FORMING (PREFORMING STEP)

CROSS SECTION FORMING (FINAL FORMING STEP)

PROCESS FOR FORMING TUBULAR MEMBER

CROSS-REFERENCE TO RELATED APPLICATIONS

The present application is a national phase application of the International Application No. PCT/JP02/11009, filed on Oct. 23, 2002, which claims priority based on the Japanese patent application No. 2001-325882, filed on Oct. 24, 2001. The entire subject matter of these priority documents is incorporated by reference herein.

FIELD OF THE INVENTION

The present invention relates to a process for forming a tubular member which enables a tubular member of high precision to be formed from a tubular starting metal material by hot forming the tubular starting material using a pre-forming mold, in an initial molding step, which is kept at temperatures equal to or higher than the recrystallization temperature of the material, in combination with a final-forming mold, used in a final molding step, which is kept at temperatures equal to or lower than the recrystallization temperature of the same.

BACKGROUND ART

Conventionally, bulge processing has been known as one of the technical means of press forming, which is used for forming a tubular metal starting material into a tubular member which has a deformed cross section having expanded portions in the appropriate places across its length. The bulge process is a process for forming a tubular material into a desired form by clamping a mold in which the tubular starting material is set and then applying an internal pressure by the use of fluid pressure to the interior of the tubular starting material to allow the material to expand and fit onto the surface of the cavity of the mold. Such a conventional bulge process is usually carried out by cold forming at, for example, room temperature.

The cold bulging process, however, has a problem with its execution because it requires a very high pressure to be applied to the interior of the tubular starting material, and therefore, requires a large-scale equipment. As a result of the high pressure requirement, it is hard to process materials of high strength.

To overcome such a problem, there have been various proposed hot bulging means wherein bulging is carried out while the forming mold is heated (see Japanese Patent Application Laid-open No. 62-270229, Japanese Patent Application Laid-open No. 62-259623 and Japanese Patent Application Laid-open No. 62-259624). In these hot bulging means, both a heating function and a cooling function are provided to the mold itself, so that the starting material set in the mold is heated, swelled when a pressure is applied to its inside, then while the mold is cooled to prevent its overheating, the starting material is prevented from swelling more than necessary which prevents the mold itself from fracturing.

In conventional hot bulging means, however, the heat efficiency is poor, and deterioration in mold during the early stage of its use is caused because of the repeated heating and cooling in the same mold. Furthermore, conventional hot bulging means have a problem of taking a long time to form a product, depending on a shape of the product, and being poor in precision. Thus conventional hot bulging means are unsuitable for forming a tubular member, which is required to be of high precision and of high quality, because a sequence of forming steps are completed in one mold.

DISCLOSURE OF THE INVENTION

The present invention has been made in the light of the above-mentioned circumstances. Accordingly, the object of the invention is to provide a novel process for forming a tubular member of high quality and high precision from a tubular starting material by hot pre-forming the tubular starting material using a pre-forming mold. The pre-forming mold is kept at temperatures equal to or higher than the recrystallization temperature of the starting material. The hot final-forming of the pre-formed material using a final forming mold is performed. The final forming mold is kept at temperatures equal to or lower than the recrystallization temperature of the material. Such novel process drastically increases the productivity.

In order to accomplish the above-mentioned object, in accordance with a first aspect of the invention, there is proposed a process for forming a tubular member into a desired shape while applying an internal pressure to the material, the process including: a pre-forming step of preforming a pre-formed tube from the tubular starting material by setting the starting material into the cavity of a pre-forming mold and clamping the pre-forming mold while applying an internal pressure to the starting material; and a final-forming step of final forming the preformed tube into a tubular member having a cross section of desired shape by setting the preformed tube into the cavity of a final forming mold and clamping the final forming mold while applying a predetermined internal pressure to the preformed tube, wherein the temperature of the pre-forming mold, in which pre-forming is carried out, is controlled so that the pre-forming mold is kept at temperatures equal to or higher than the recrystallization temperature of the tubular material, while the temperature of the final forming mold, in which final forming is carried out, is controlled so that the final forming mold is kept at temperatures equal to or lower than the recrystallization temperature of the preformed tube.

In accordance with this first aspect, a tubular member of high precision and high quality can be formed and the productivity is drastically increased because the forming of a tubular starting material is divided into two steps: a hot pre-forming step using a preforming mold kept at temperatures equal to or higher than the recrystallization temperature of the starting material; and a hot final forming step using a final forming mold kept at temperatures equal to or lower than the recrystallization temperature of the material.

In order to accomplish the above-mentioned object, in accordance with a second aspect of the invention, in addition to the first aspect, there is proposed a process for forming a tubular member, wherein the process of pre-forming includes a tube-expanding forming step which expands certain portions of the tubular member.

In accordance with this second aspect, in particular, a tubular member having expanded portions can be formed with high precision and high quality and wherein the productivity of the process is drastically increased.

In order to accomplish the above-mentioned object, in accordance with a third aspect of the invention, in addition to the first aspect, there is proposed a process for forming a tubular member, wherein the pre-forming includes a tube-expanding forming step which expands certain portions of the tubular member and a bending forming step which bends certain portions of the tubular member.

In accordance with this third aspect, in particular, a tubular member having expanded portions and bent portions can be formed with high precision and high quality and the productivity of the process is drastically increased.

BEST MODE FOR CARRYING OUT THE INVENTION

In the following paragraphs, illustrative embodiments of this invention are described in detail in conjuncton with the accompanying drawings.

A tubular material Pa formed in accordance with the forming process of this embodiment is a hollow cylindrical material of aluminum alloy with both of its ends open, and it is heated to about 500° C. by heating means before being carried into a first mold M1 for pre-forming. As a heating means, electric heating is employed in this embodiment, but heating may also be carried out in a furnace.

A forming process according to this embodiment includes:

(1) a pre-forming step of pre-forming the tubular starting material, [said pre-forming step includes a tube-expanding forming (bulge-forming) step and bending step]; and (2) a final-forming step of final forming a pre-formed tube, which is the tubular starting material after the pre-forming step, into a tubular member of final shape and a sequence of the above forming steps which is carried out continuously in a first, second and third molds M1, M2 and M3 (described later).

Figure 2:
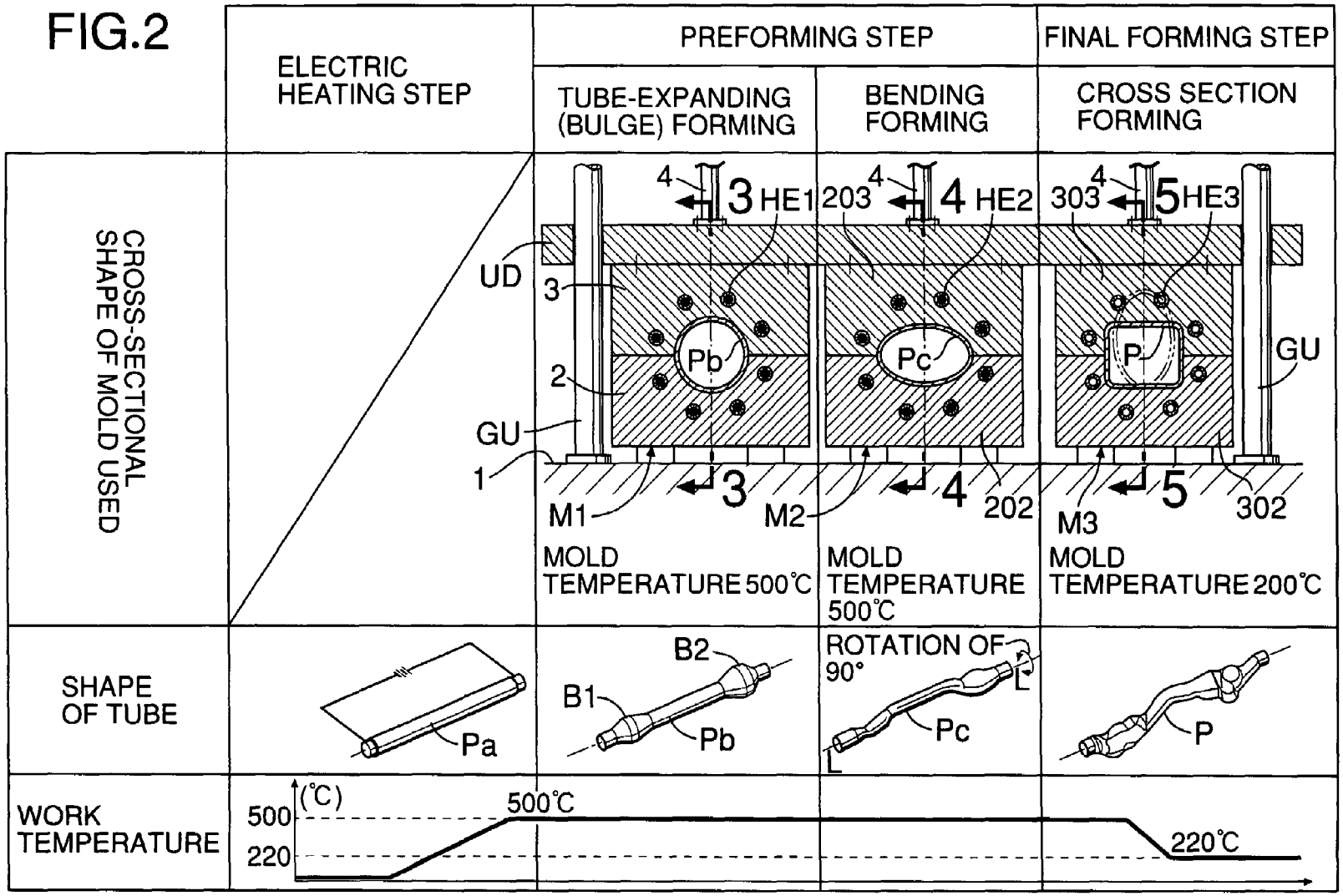
FIG. 2 is a diagram showing production steps of producing a tubular member by hot forming according to the present invention.

As shown in FIG. 2, the first, second and third molds M1, M2 and M3 are arranged in parallel on a base 1 and the first and second molds M1 and M2 are used in the pre-forming step of pre-forming the tubular starting material and the third mold M3 is used in the final forming step of forming the preformed tube.

The first, second and third molds M1, M2 and M3 are formed of stationary molds 2, 202, 302 mounted fixedly in line on a base 1 and moving molds 3, 203, 303, which correspond to the respective stationary molds; the moving molds 3, 203, 303 are integrally connected to an up-and-down member UD which extends over the moving molds; to the up-and-down member UD, an up-and-down cylinder 4 as a clamping cylinder is connected; and the first, second and third moving molds 3, 203, 303 are synchronized and allowed to perform up-and-down action by the expansion action of the up-and-down cylinder 4. Between the base 1 and the up-and-down member UD, a guide GU is provided. The guide GU guides the up-and-down movement of the up-and-down member UD.

The first mold M1 is a tube-expanding forming mold for carrying out hot tube-expanding forming (hot bulge-forming) at temperatures equal to or higher than the recrystallization temperature of a hollow cylindrical tubular starting material of aluminum alloy (hereinafter referred to as a tubular material Pa), which is heated, in advance to and kept at about 500° C., in the tube-expanding forming mold. Conventionally known heating means such as a high-frequency-current heating means, heater heating means or the like can be used as a heating means HE1 for heating the mold to about 500° C.

The second mold M2 is a bending forming mold for carrying out hot bending forming at temperatures equal to or higher than the recrystallization temperature of the expanded tubular starting material formed in the first mold M1 (hereinafter referred to as a tubular material Pb), and also included in the bending forming mold M2, is a heating means HE2 for heating the mold M2 to about 500° C.. Conventionally known heating means such as a high-frequency-current heating means, heater heating means or the like may be used as heating means HE2 for heating the mold to about 500° C.

The pre-forming step according to the present invention includes the hot tube-expanding forming (hot bulge-forming) step and the hot bending forming step in combination.

The third mold M3 is a final forming mold for carrying out cross-section forming by crushing the tubular material(hereinafter referred to as tubular material Pc) having undergone hot tube-expanding forming (bulging) and hot bending forming in the first and second molds M1, M2, respectively, into a desired shape at temperatures equal to or lower than the recrystallization temperature of the tubular material Pc, and in the final forming mold M3, heating means HE3 for heating the mold M3 to about 200° C., for example, fluid heating means is provided. Since the tubular material Pc is still in the heated state (preformed at about 500° C.), when it is set in the third mold M3, heat is transferred from the tubular material Pc to the third mold M3, which is kept at temperatures equal to or lower than the recrystallization temperature of the tubular material Pc, and thus the tubular material Pc undergoes hot final forming in the third mold M3 while being controlled so that its temperature is decreased.

The above-mentioned steps are described in detail hereinbelow.

(1) Step of Subjecting the Tubular Material Pa to Tube-Expanding (Bulge) Forming (First Step)

The tubular starting material of aluminum alloy (hereinafter referred to as tubular material Pa) heated in advance to about 500° C., is carried to the first mold M1 and introduced into the first mold M1 which has also been heated to about 500° C., that is, the temperature equal to or higher than the recrystallization temperature of the tubular material Pa. Part of the tubular material Pa, which is being kept at a temperature equal to or higher than the recrystallization temperature, undergoes hot tube-expanding forming (hot bulgeforming), which in this embodiment occurs at the sites B1, B2 near its opposite ends (see FIG. 1A).

Figure 3:
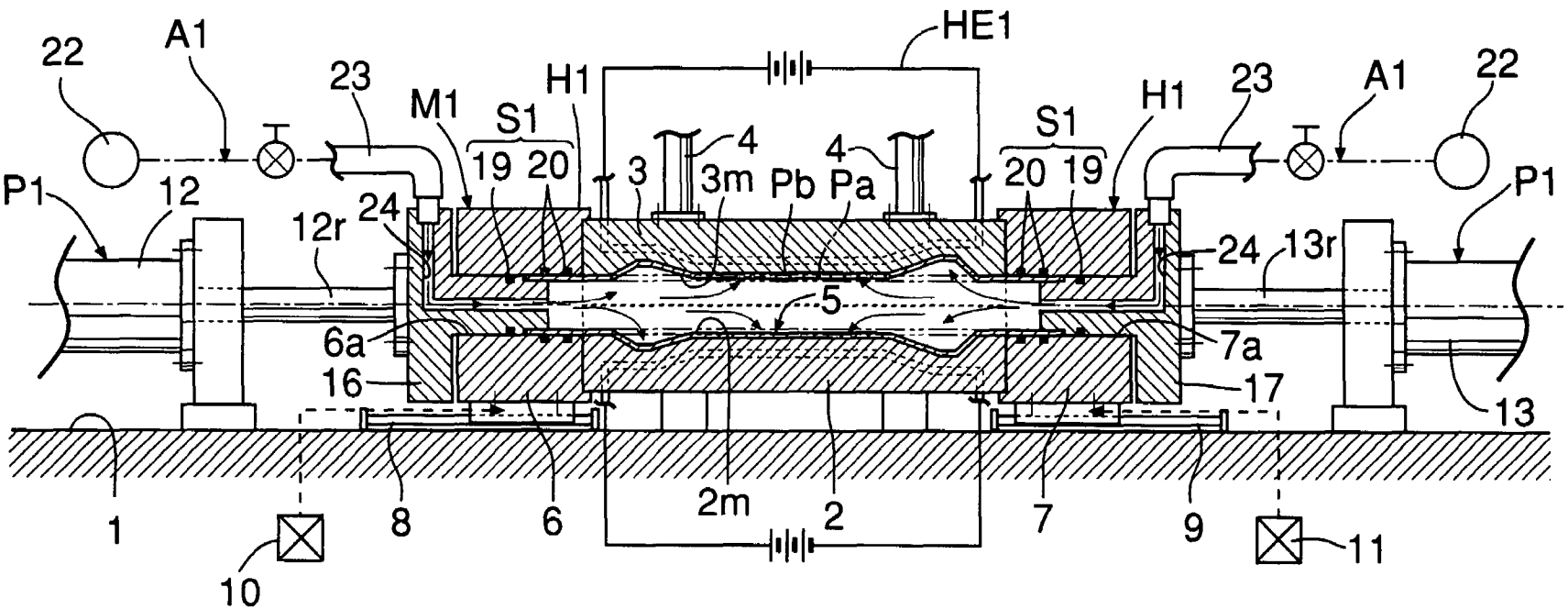
FIG. 3 is a cross sectional view along the line 3-3 of FIG. 2.

As shown in FIG. 3, the first mold M1 includes a stationary mold on the base 1, that is, a lower mold 2 and a moving mold, that is, an upper mold 3 whose up-and-down action above the lower mold 2 is controlled by the action of the up-and-down cylinder 4; on the top surface of the lower mold 2 is formed a lower mold forming surface 2*m* for forming the lower half of the tubular material Pa; on the bottom surface of the upper mold 3 is formed an upper mold forming surface 3*m* for forming the upper half of the tubular material Pa; and when clamping the first mold M1, the forming surfaces 2*m* and 3*m* form a cavity 5. On opposite sides of the first mold M1 are provided hold means H1 for fixing opposite ends of the tubular material Pa. The hold means H1 are each provided with left and right holders 6, 7 on each side of the first mold M1, and the holders 6, 7 are movable back and forth relative to the first mold M1 and their movement on guides 8, 9, which are provided on the base 1, are controlled by the operation of actuators 10, 11. The opposite end portions of the tubular material Pa are fitted and fixed into the supporting holes 6*a*, 7*a* of the left and right holders 6, 7 by the forward movement thereof.

On the opposite sides of the first mold M1 are provided pressing means P1 for pressing from the axial direction the tubular material Pa set in the mold M1. The pressing means P1 include left and right pressing cylinders 12, 13, respectively; pressing members 16, 17 fixed on the tip of the rod portions 12*r*, 13*r* of the pressing cylinder 12, 13 are fitted into the support hole 6*a*, 7*a* of the left and right holders 6, 7 in the back and forth movable manner; the tips of the pressing members 16, 17 are respectively engaged with the opposite ends of the tubular material Pa by the extension action of the left and right pressing cylinders 12, 13; and the tubular material Pa can be axially pressed from its opposite sides by the subsequent forward movement of the pressing members 16, 17.

Between the left and right pressing members 16, 17 and the supporting holes 6*a*, 7*a* and between the supporting holes 6*a*, 7*a* and outer peripheral surfaces of opposite end portions of the tubular material Pa are provided O rings 19, 20 as sealing means S1, and these O rings 19, 20 can provide a fluid tight seal between the tubular material Pa and the holders 6, 7, and between the tubular material Pa and the pressing members 16, 17, when the pressing members 16, 17 are engaged with the tubular material Pa.

On opposite sides of the first mold M1 are provided compressed air supplying means A1 for pressurizing the inside of the tubular material Pa. The compressed air supplying means A1 are so constructed that they feed compressed air under pressure from compressed air supplying sources 22 to the closed hollow portion of the tubular material Pa via compressed air circuits 23 and air introducing paths 24 pierced in the pressing members 16, 17.

After introducing and setting the tubular material Pa, which has been heated to about 500° C. in the heating step as a pre-step, in the first mold M1, which has also been heated to about 500° C. by the heating means HE1, the first mold M1 is clamped by the operation of the clamping cylinder 4.

If an extension action is given to the pressing cylinders 12, 13 after fixing opposite ends of the tubular material Pa by means of the forward movement of the left and right holders 6, 7, the rod portions 12*r*, 13*r* press the tubular material Pa axially and allow pressurizing air to be fed from the compressed air source 22 into the tubular material Pa via the compressed air supplying path 23 and the air introducing path 24 while carrying out the axial pushing, and an internal pressure is applied to the tubular material Pa. The sites B1, B2 of opposite end portions of the tubular material Pa undergo tube-expanding forming (bulge-forming) so that the tubular material Pa follows the upper and lower forming surfaces 3*m*, 2*m* of the cavity 5.

In this case, since the tube-expanding (bulge) forming is hot forming (about 500° C.), the pressure required for the forming is low compared with the case of cold forming, as a result, the forming time is reduced.

Figure 1A:
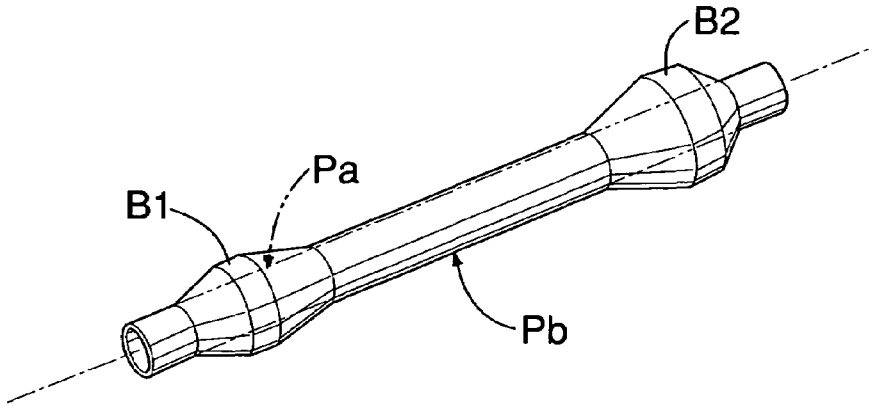
FIGS. 1A and 1B are perspective views of a tubular material after tube-expanding (bulge) forming and a tubular member after completion of forming, respectively.

The tubular starting material after tube-expanding forming (hereinafter referred to as tubular material Pb) is drawn out from the first mold M1 by opening the same after allowing the left and right holder 6, 7 to move backward. In the tubular material Pb, the sites B1, B2 near its opposite ends underwent tube-expanding forming (bulge forming), as shown in FIGS. 1A and 2.

(2) Bending Forming Step (Second Step)

The second step is a bend forming step applied to the tubular material Pb, which has undergone tube-expanding forming in the previous step.

The tubular material Pb having undergone tube-expanding forming (bulge-forming) in the above-mentioned first step is carried to the second mold M2 by known carrying means (not shown), while still in a heated state and set in the second mold M2 to undergo hot (500° C.) bending forming, which is carried out while applying an internal pressure to the tubular material Pb.

Figure 4:
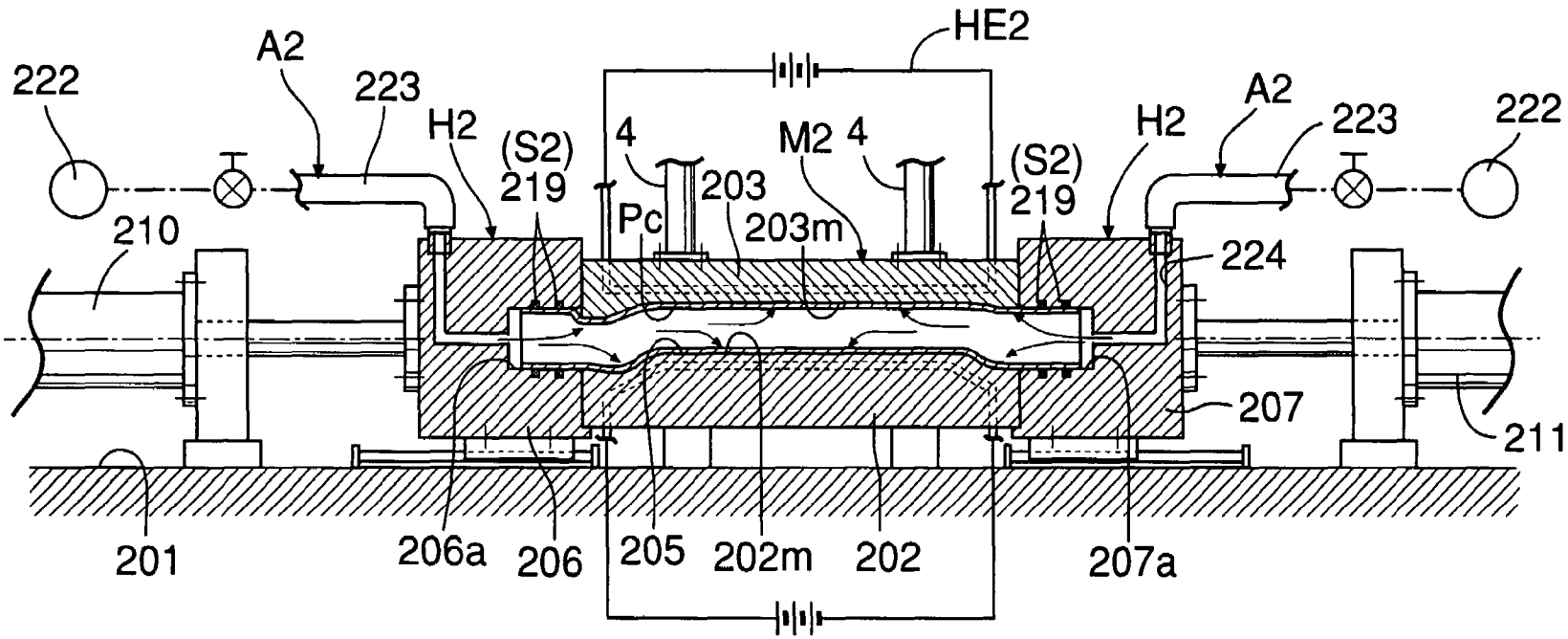
FIG. 4 is a cross sectional view along the line 4-4 of FIG. 2.

The second mold M2 has almost the same construction as the first mold M1, except that a pressing means P1 is omitted, as shown in FIG. 4. Specifically, the second mold M2 includes a stationary mold on the base 1, that is, a lower mold 202 and a moving upper mold 203 whose up-and-down action above the lower mold 202 is controlled; on the top surface of the lower mold 202 is formed a lower mold forming surface 202*m* for bending forming the lower half of the tubular material Pb; on the bottom surface of the upper mold 203 is formed an upper mold forming surface 203*m* for bending forming the upper half of the tubular material Pb; and when clamping the second mold M2, the forming surfaces 202*m* and 203*m* form a cavity 205. On opposite sides of the second mold M2 are provided hold means H2 for fixing opposite ends of the tubular material Pb, just like in the case of the first mold M1. The hold means H2 are each provided with left and right holders 206, 207, and the back and forth movement of the holders 206, 207 relative to the second mold 2 is controlled by actuators 210, 211 which are formed of expansion cylinders. The supporting holes 206*a*, 207*a* of the holders 206, 207 are provided with sealing means S2 which are formed of O rings 219 to provide an airtight seal on the opposite open ends of the tubular material Pb.

On opposite sides of the second mold M2 are provided compressed air supplying means A2 for pressurizing the inside of the tubular material Pb. The compressed air supplying means A2 are constructed such that they feed compressed air under pressure from compressed air supplying sources 222 to the closed hollow portion of the tubular material Pb, which has undergone bulging, via compressed air circuits 223 and air introducing paths 224 pierced in the holders 206, 207.

In this second step, the tubular material Pb, which is still in the heated stated after having undergone tube-expanding forming (bulge-forming) in the previous step, is introduced into the second mold M2 in which is in an opened state and set in the same. The second mold M2 has been heated to about 500° C. by the heating means HE2. Then opposite end portions of the tubular material Pb are held in the second mold M2 by allowing the left and right holders 206, 207 to take a forward action by the operation of the actuators 210, 211, and at the same time, the open ends are sealed airtight by the sealing means S2. Then an internal pressure is applied to the tubular material Pb by feeding pressurizing air under pressure from the compressed air sources 222 into the tubular material Pb via the compressed air supplying paths 223 and the air introducing paths 224 and the second mold M2 is clamped by allowing the upper mold 203 to descend by the operation of the mold clamping cylinder 4 to allow the tubular material Pb, which has undergone tube-expanding (bulge) forming, to fit to the bending forming surfaces 203*m*, 202*m* of the upper and lower molds 203, 202, and hot (about 500° C.) bending is carried out in such a state.

Figure 1B:
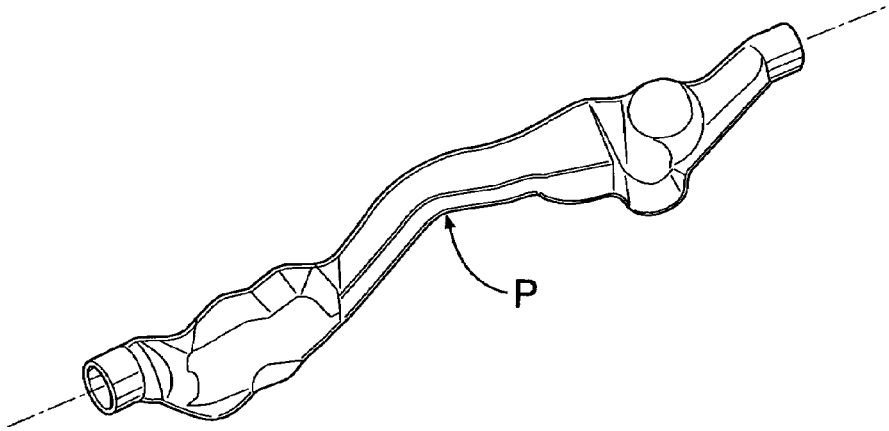

The tubular material having undergone this bending forming step, that is, the preformed tube (hereinafter referred to as tubular material Pc) has its middle portion bended, as shown in FIG. 1B, and its cross section takes the form of an oval crushed upwards and downwards.

The pre-forming step following the present invention is thus made up of the tube-expanding forming (bulge forming) step and the bending forming step. This pre-forming step enables the speeding up of the forming, reduction of the forming pressure, downsizing of the forming equipment and simplification of the forming equipment structure compared with the cold forming, since it is hot forming carried out at temperatures equal to or higher than the recrystallization temperature (about 500° C.) of the tubular material.

(3) Cross-Section Forming Step (Third Step)

This step is a cross-section forming step (final forming step) in which the cross section of the tubular material Pc is formed into a final completed shape. In this cross-section forming step, the tubular material Pc which has undergone tube-expanding forming (bulge forming) and bending forming in the first and second steps and is still in the heated state, is introduced into the third mold M3 by known carrying means (not shown), and set in the same to undergo cross-section forming.

Figure 5:
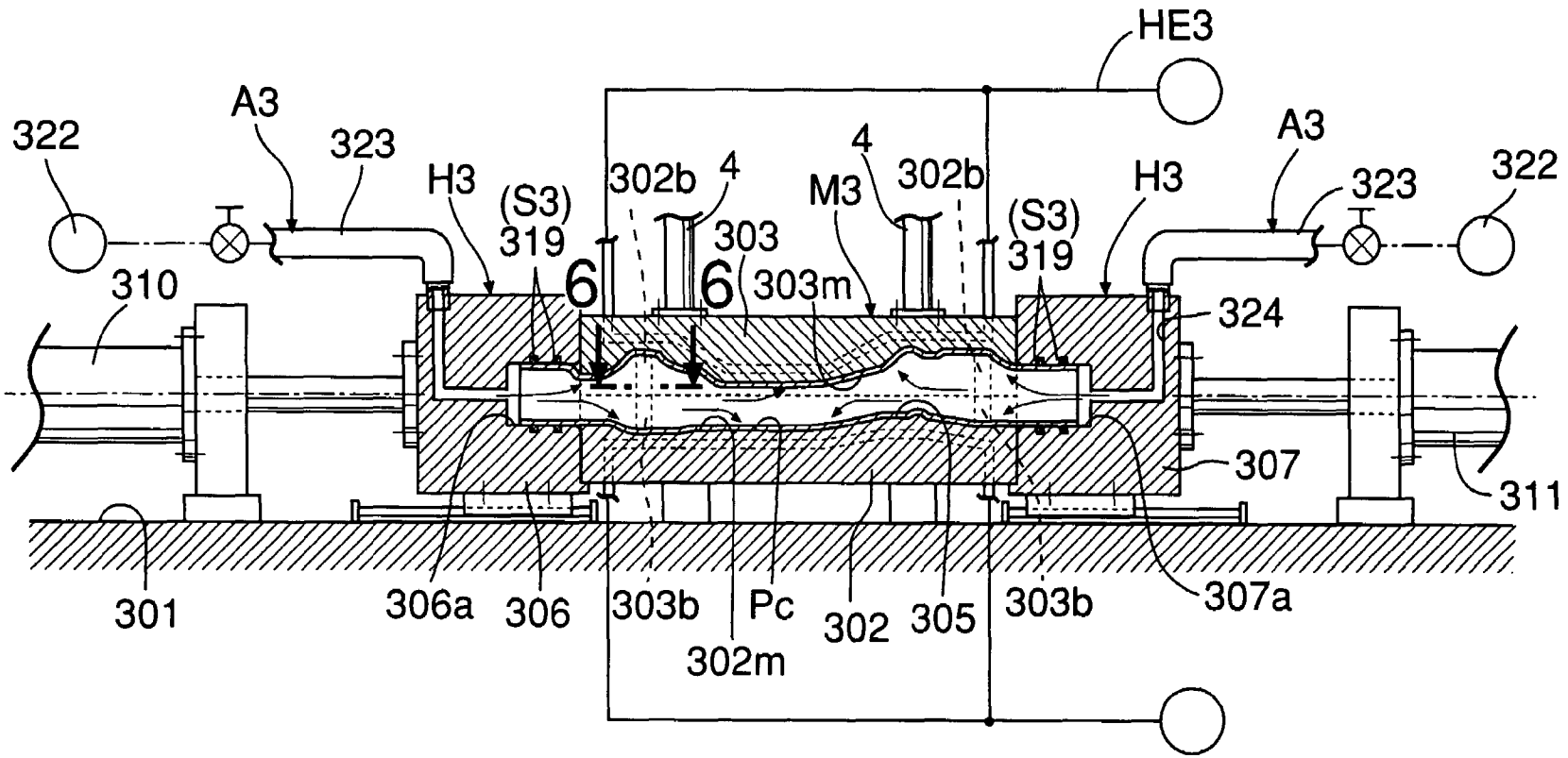
FIG. 5 is a cross sectional view along the line 5-5 of FIG. 2.
Figure 6:
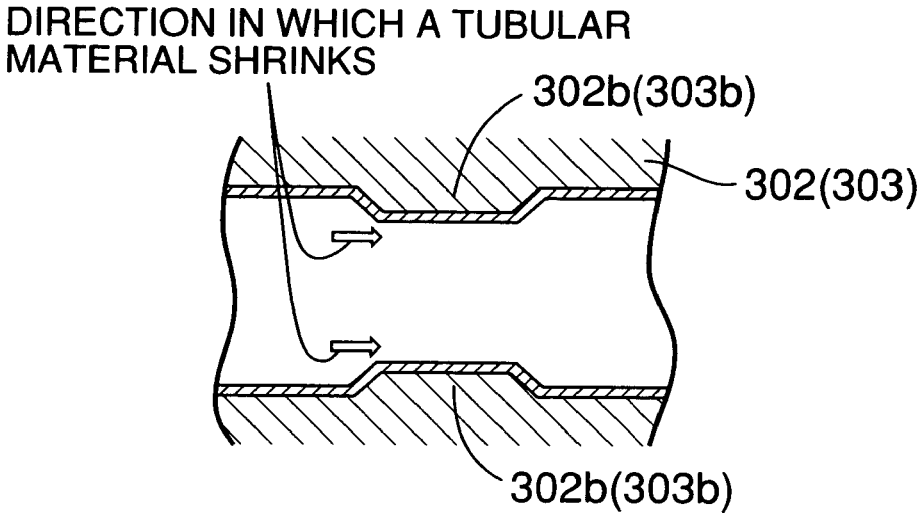
FIG. 6 is an enlarged cross sectional view along the line 6-6 of FIG. 5.
Figure 7:
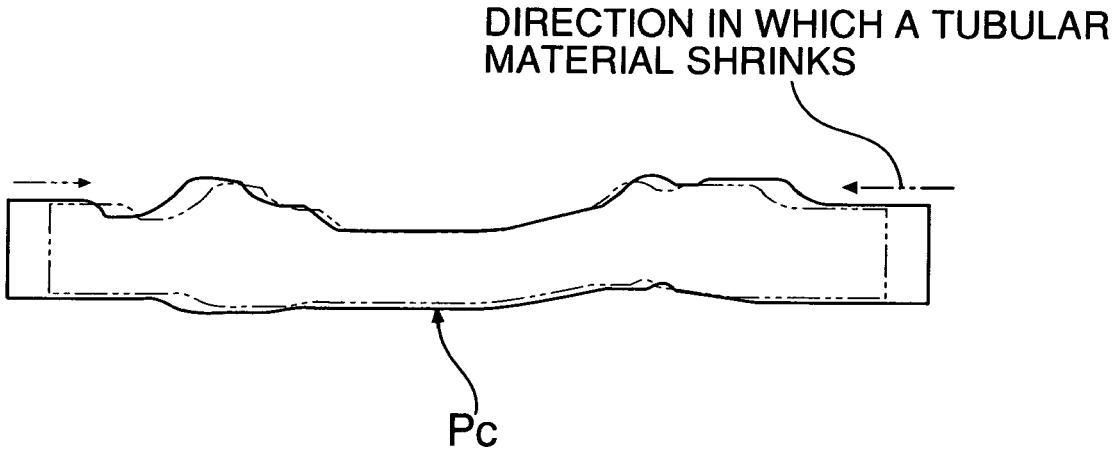
FIG. 7 is a view showing the state in which a tubular material undergoes axial heat shrinkage at a final forming step.

The third mold M3 has substantially the same construction as the second mold M2. As shown in FIGS. 5, 6, it includes a stationary lower mold 302 and an upper mold 303 whose up-and-down action above the lower mold 302 is controlled, and on the top surface of the lower mold 302 and on the bottom surface of the upper mold 303 are formed forming surfaces 302*m*, 303*m* for forming the cross section of the tubular material Pc, respectively. When the third mold M3 is clamped, the forming surfaces 302*m* and 303*m* form a cavity 305 for cross-section forming.

On opposite sides of the forming surfaces 303*m*, 302*m*, as shown in FIG. 6, 302*m* are formed constraining beads 302*b*, 303*b*, respectively, and these constraining beads 302*b*, 303*b* are engaged with opposite ends of the tubular material Pc in the final forming step to constrain the axial shrinkage of the tubular material Pc during the final forming.

On opposite sides of the third mold M3 are provided hold means H3 for fixing opposite ends of the tubular material Pc The hold means H3 are each provided with left and right holder 306, 307, and the back and forth movement of the holders 306, 307 relative to the third mold M3 is controlled by actuators 310, 311 which are made up of expansion cylinders. To the supporting holes 306*a*, 307*a* of the holders 306, 307 are provided sealing means S3 which are made up of O rings 319 to air-tightly seal opposite open ends of the tubular material Pc.

On opposite sides of the third mold M3 are provided compressed air supplying means A3 for pressurizing the inside of the tubular material Pc. The compressed air supplying means A3 are so constructed that they feed compressed air under pressure from compressed air supplying sources 322 to the closed hollow portion of the tubular material Pc, via compressed air circuits 323 and air introducing paths 324 pierced in the holders 306, 307.

The third mold M3 is kept at about 200° C. by heating means HE3. Since the tubular material (preformed tube) Pc, which has undergone bending forming at the second step, is still in the heated state (formed at about 500° C.), when it is set in the third mold M3, as such heat is transferred from the tubular material Pc to the third mold M3. As a result, the temperature of the mold is increased, but on the other hand, the tubular material Pc is controlled so that its temperature is decreased. Thus, the tubular material Pc, which is formed into an end product shape using the third mold, is not affected by the heat of the third mold M3 and prevented from deforming by heat in the third mold M3.

The tubular material Pc, as shown in FIG. 2, is rotated around the axis L-L at about 90° (the angle varies depending on the tubular material Pc) by a rotating means (not shown), and then is carried in the third mold M3 in the open state and set in the same. After this, opposite end portions of the tubular material Pc are fixed in the third mold M3 by the forward movement of the holders 306, 307, and at the same time, they are provided with a fluid tight seal by sealing means S3, and the holder 306, 307 are moved forward. Then the upper mold 303 is allowed to descend by the operation of the clamping cylinder 4 to clamp the third mold M3, an internal pressure is applied to the inside of the tubular material Pc by compressed air supplying means A3, and load is applied to the tubular material Pc in such a state from the direction orthogonal to the length of the tubular material Pc to crush the cross section of the tubular material so that the material to fit to the forming surfaces of the upper and lower molds 303, 302. Thus the tubular material Pc undergoes cross-section forming and is formed into a final completed shape having, for example, rectangular cross section with small R corner portions. In this forming, the third mold M3 is kept at about 200° C., that is, at the temperature equal to or lower than the recrystallization temperature of the tubular material (preformed tube) Pc, while the tubular material Pc is kept at the temperature (about 500° C.) higher than that of the third mold M3 (about 200° C.). Therefore, hot forming of the tubular material Pc is substantially possible even in the third mold M3, which is kept at temperatures equal to or lower than the recrystallization temperature of the tubular material Pc. Accordingly, the tubular material Pc is not affected and deformed by heat from the third mold M3. In addition, its axial heat shrinkage is constrained since its opposite end portions are engaged with the above-mentioned constraining beads 302*b*, 303*b* by the mold clamping of the third mold M3. Thus forming can be carried out while avoiding the external influences on the tubular material Pc and inhibiting the material from the axial heat shrinking in the third mold M3.

The final cross-section forming is carried out while keeping the temperature of the third mold M3 equal to or lower than the recrystallization temperature of the tubular material Pc, and then the tubular material Pc is cooled while keeping the mold M3 in the mold clamped state for a specified period of time.

This operation inhibits variation in shrinkage of the tubular material Pc which is created by cooling when the material is drawn out of the third mold M3 after the final forming. The operation also prevents the tubular material Pc from deforming which is caused when the material is handled, in other words, when the tubular member P shown in FIG. 1B is drawn out of the third mold M3 while opening the same. Furthermore, the tubular member P is not deformed by the external conditions such as air cooling after it is drawn out from the mold.

The combination of the first to third steps, specifically, the combination of the hot preforming using the first and second molds M2, M3 at temperatures equal to or higher than the recrystallization of the tubular material and the hot final forming using the third mold M3 at temperatures equal to or lower than the recrystallization of the tubular material enables formation of a tubular member P which is free from variation in precision, of high precision and of high quality, and has drastically increased the productivity.

Thus, the tubular member P, as an end product, formed in the first to third steps is used as a frame member, etc. for vehicles.

Although the embodiment of the present invention has been described in detail, it will be understood that the present invention is not limited to the above-described embodiment, and various modifications in design may be made without departing from the subject matter of the invention defined in the claims.

For example, in the above embodiment, the forming process of this invention is applied to the case where a tubular material is aluminum alloy, but it is without saying that the process can also be applied to tubular materials of other metals. In such a case, the temperatures of heating tubular materials and molds are controlled depending on the material used. In this embodiment, air is used as compressed fluid for applying an internal pressure to the tubular material, other fluids can also be used as long as they produce the same effect.

What is claimed is:

1. A process for forming a tubular member, in which a tubular starting material is formed into a desired shape while applying an internal pressure to the tubular starting material, said process comprising:

a step of providing a pre-forming mold having a cavity formed therein and a final forming mold having a cavity formed therein, a pre-forming step of pre-forming said tubular starting material into a preformed tube by setting the tubular starting material into the cavity of the pre-forming mold and clamping the pre-forming mold while applying an internal pressure to the tubular starting material, wherein the tubular starting material has a recrystallization temperature; and a final forming step of final forming the preformed tube into the tubular member having a cross section of a desired shape by setting the preformed tube into the cavity of the final forming mold and clamping the final forming mold while applying a predetermined internal pressure to the preformed tube, wherein the preformed tube has a recrystallization temperature, and wherein a respective temperature of each of the mold is controlled so that the pre-forming mold is kept at a temperature equal to or higher than the recrystallization temperature of the tubular starting material, while the final forming mold is kept at a temperature equal to or lower than the recrystallization temperature of the preformed tube.

2. The process for forming a tubular member according to claim 1, wherein the pre-forming is tube-expanding forming.

3. The process for forming a tubular member according to claim 1, wherein the pre-forming is tube-expanding forming and bending forming.

* * * * *